US008646681B2

(12) United States Patent
Lindquist

(10) Patent No.: US 8,646,681 B2
(45) Date of Patent: Feb. 11, 2014

(54) FRIES AND CONDIMENT HOLDER

(76) Inventor: Scott Lindquist, Huntington, NY (US)

( * ) Notice: Subject to any disclaimer, the term of this patent is extended or adjusted under 35 U.S.C. 154(b) by 325 days.

(21) Appl. No.: 13/109,674

(22) Filed: May 17, 2011

(65) Prior Publication Data

US 2012/0134604 A1 May 31, 2012

Related U.S. Application Data

(60) Provisional application No. 61/417,953, filed on Nov. 30, 2010, provisional application No. 61/439,059, filed on Feb. 3, 2011.

(51) Int. Cl.
*B65D 3/00* (2006.01)

(52) U.S. Cl.
USPC ..... 229/400; 229/904; 229/120.01

(58) Field of Classification Search
USPC ..... 229/400, 904, 405, 906, 902, 120.01, 229/117.03, 117.04; 383/32, 40; 220/23.4, 220/23.83, 482, 528; D9/347
See application file for complete search history.

(56) References Cited

U.S. PATENT DOCUMENTS

| | | | | | |
|---|---|---|---|---|---|
| 4,854,466 | A * | 8/1989 | Lane, Jr. | ..... | 220/23.83 |
| 4,955,528 | A * | 9/1990 | Schluckebier | ..... | 229/120.18 |
| 5,137,210 | A * | 8/1992 | Hibbs | ..... | 229/120.18 |
| 5,417,364 | A * | 5/1995 | Shaw | ..... | 229/400 |
| 5,540,333 | A * | 7/1996 | Gonzalez et al. | ..... | 206/541 |
| 5,626,283 | A * | 5/1997 | Mellon | ..... | 229/120.13 |
| 5,630,544 | A * | 5/1997 | Shane | ..... | 229/117.06 |
| 6,102,208 | A * | 8/2000 | Huang | ..... | 206/541 |
| 6,152,362 | A * | 11/2000 | Rosenfeld | ..... | 229/400 |
| 6,182,890 | B1 * | 2/2001 | Sattler et al. | ..... | 229/400 |
| 6,230,969 | B1 * | 5/2001 | Spransy | ..... | 229/400 |
| 6,349,874 | B1 * | 2/2002 | Hill | ..... | 229/120.18 |
| 6,357,652 | B1 * | 3/2002 | Evans et al. | ..... | 229/120.01 |
| 6,419,153 | B1 * | 7/2002 | Maita | ..... | 229/400 |
| 7,140,532 | B2 * | 11/2006 | Holt et al. | ..... | 229/120.13 |
| 7,520,417 | B2 * | 4/2009 | Biedermann et al. | .... | 229/120.15 |
| 2001/0030227 | A1 * | 10/2001 | Fear et al. | ..... | 229/120.01 |
| 2002/0056743 | A1 * | 5/2002 | Barcat et al. | ..... | 229/120.01 |
| 2003/0006274 | A1 * | 1/2003 | Lackner et al. | ..... | 229/400 |
| 2006/0022024 | A1 * | 2/2006 | Krimsky et al. | ..... | 229/120.18 |
| 2008/0093433 | A1 * | 4/2008 | Haroutiounian | ..... | 229/400 |
| 2010/0025456 | A1 * | 2/2010 | McCann | ..... | 229/117.06 |

* cited by examiner

*Primary Examiner* — Gary Elkins
*Assistant Examiner* — Phillip Schmidt
(74) *Attorney, Agent, or Firm* — Sinorica, LLC

(57) ABSTRACT

The fries and condiment holder is a combination of two open containers. The larger of the two open containers provides the user with a place to store a food item found at fast food restaurants such as French fries. The smaller of the two open containers is attached to the larger container by a nontoxic adhesive because the present invention makes contact with edible food. The smaller container provides the user with a place to store a condiment. The smaller container is also collapsible and can be flushed into larger container. The user obtains the present invention with the food item in the larger container and with the small container collapse. The user can choose to expand and fill the smaller container with a condiment if the user wants to dip his/her food item in the condiment.

2 Claims, 6 Drawing Sheets

FRIES AND CONDIMENT HOLDER

The current application claims a priority to the U.S. Provisional Patent application Ser. No. 61/417,953 filed on Nov. 30, 2010 and the U.S. Provisional Patent application Ser. No. 61/439,059 filed on Feb. 3, 2011.

FIELD OF THE INVENTION

The present invention relates generally to an apparatus for holding French fries. More particularly, the present invention provides the user with a condiment compartment attached to a French fry holder for placing condiments.

BACKGROUND OF THE INVENTION

When buying French fries at a fast food restaurant, most users typically put ketchup on a napkin or inside the French fries container with the fries, which causes unnecessary mess. Most fast food chains do not provide their customers with a means to hold their condiments. Therefore, the objective of the present invention is to introduce an apparatus for incorporating an additional compartment to the conventional French fry holder seen in most fast food restaurants. It is a further object of the present invention to allow for the extra compartment to be refracted and folded when not in use and to remain attached to the body of the French fry holder. The extra compartment is called the condiment compartment. The condiment compartment does not affect how the French fry holder is packaged and shipped around the world. The present invention is either folded and stacked or just stacked like a conventional French fry holder.

DETAIL DESCRIPTIONS OF THE INVENTION

All illustrations of the drawings are for the purpose of describing selected versions of the present invention and are not intended to limit the scope of the present invention.

Figure 1:
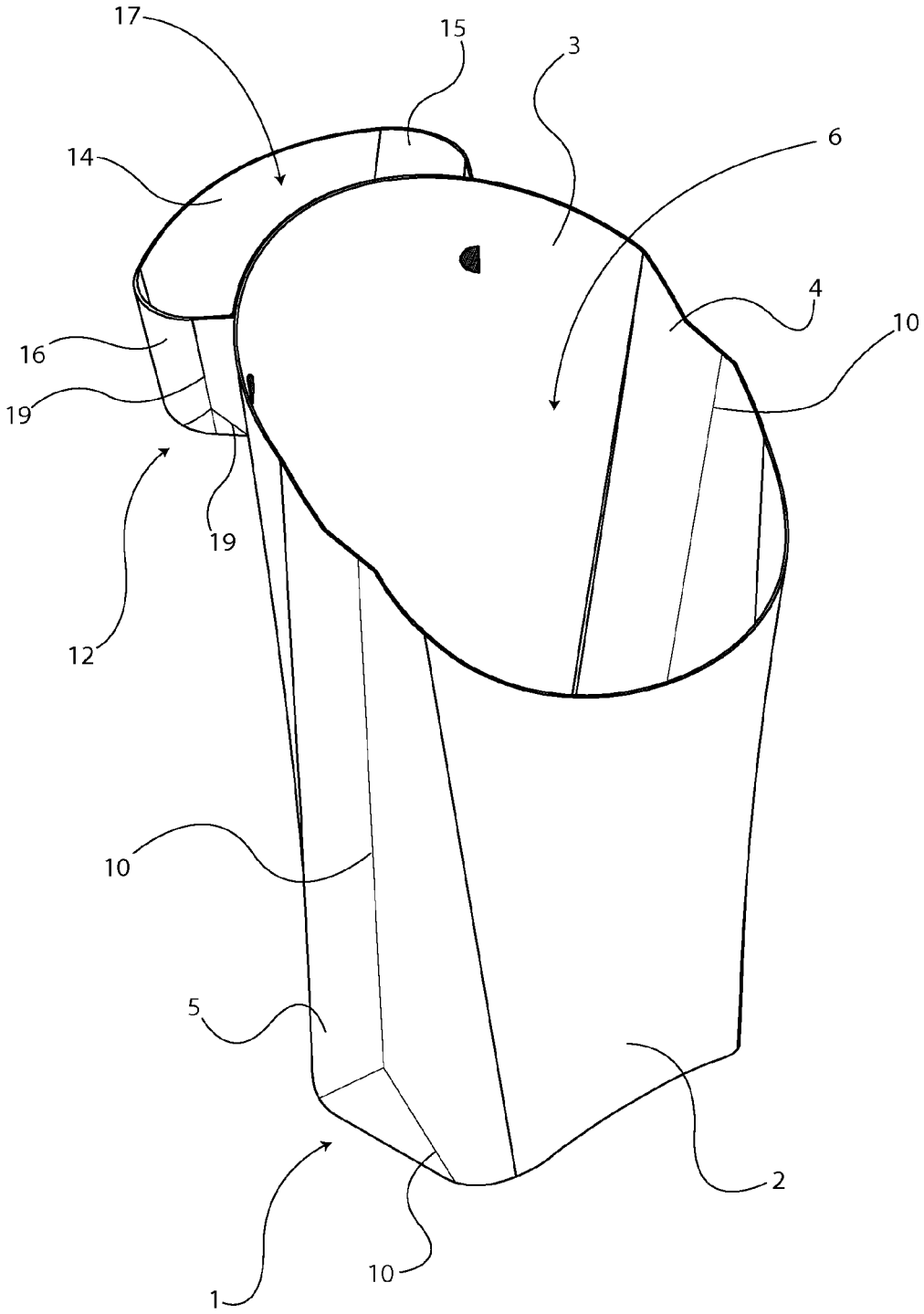
FIG. 1 is a perspective view of the present invention with the condiment compartment expanded.
Figure 2:
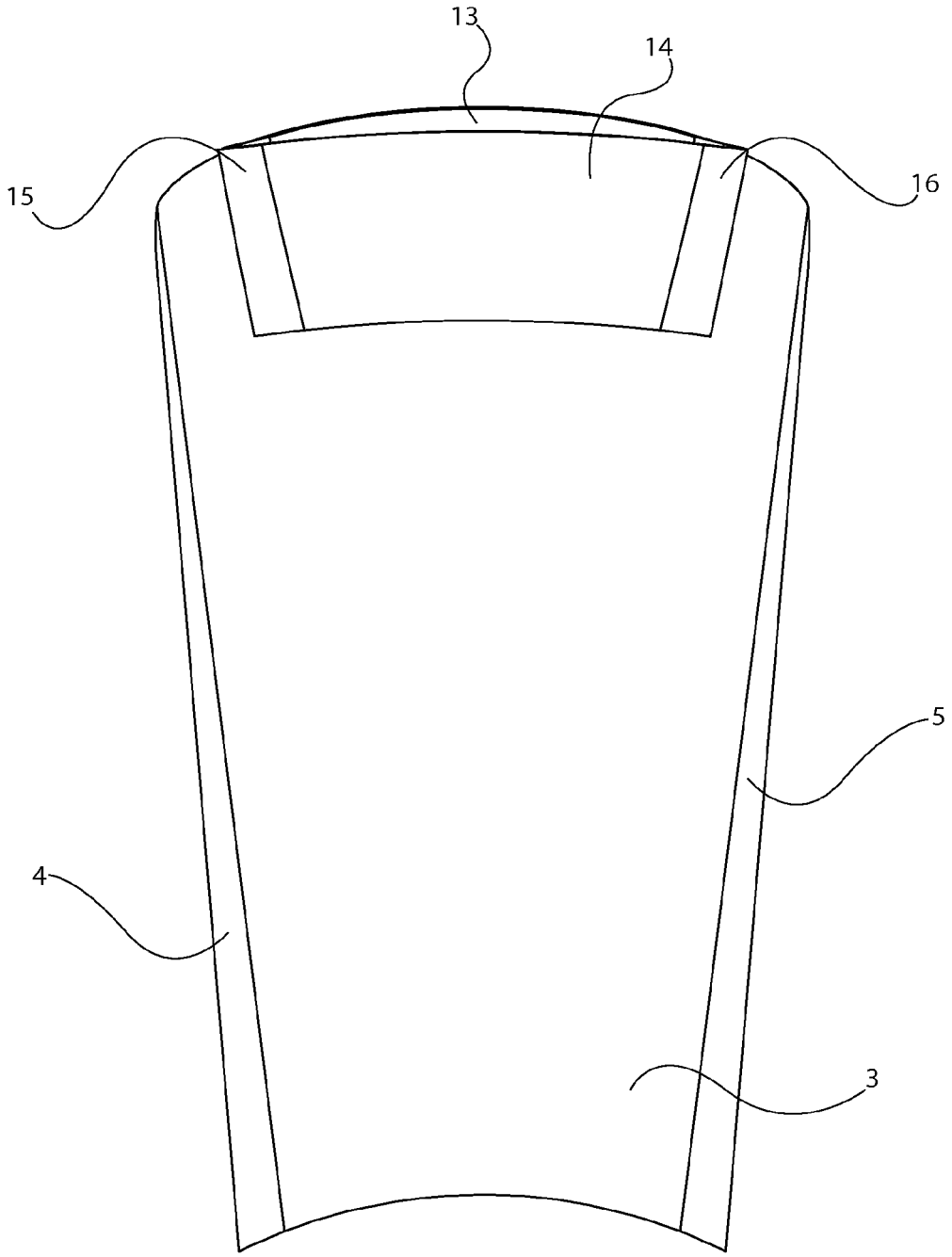
FIG. 2 is a back view of the present invention with the condiment compartment expanded.
Figure 3:
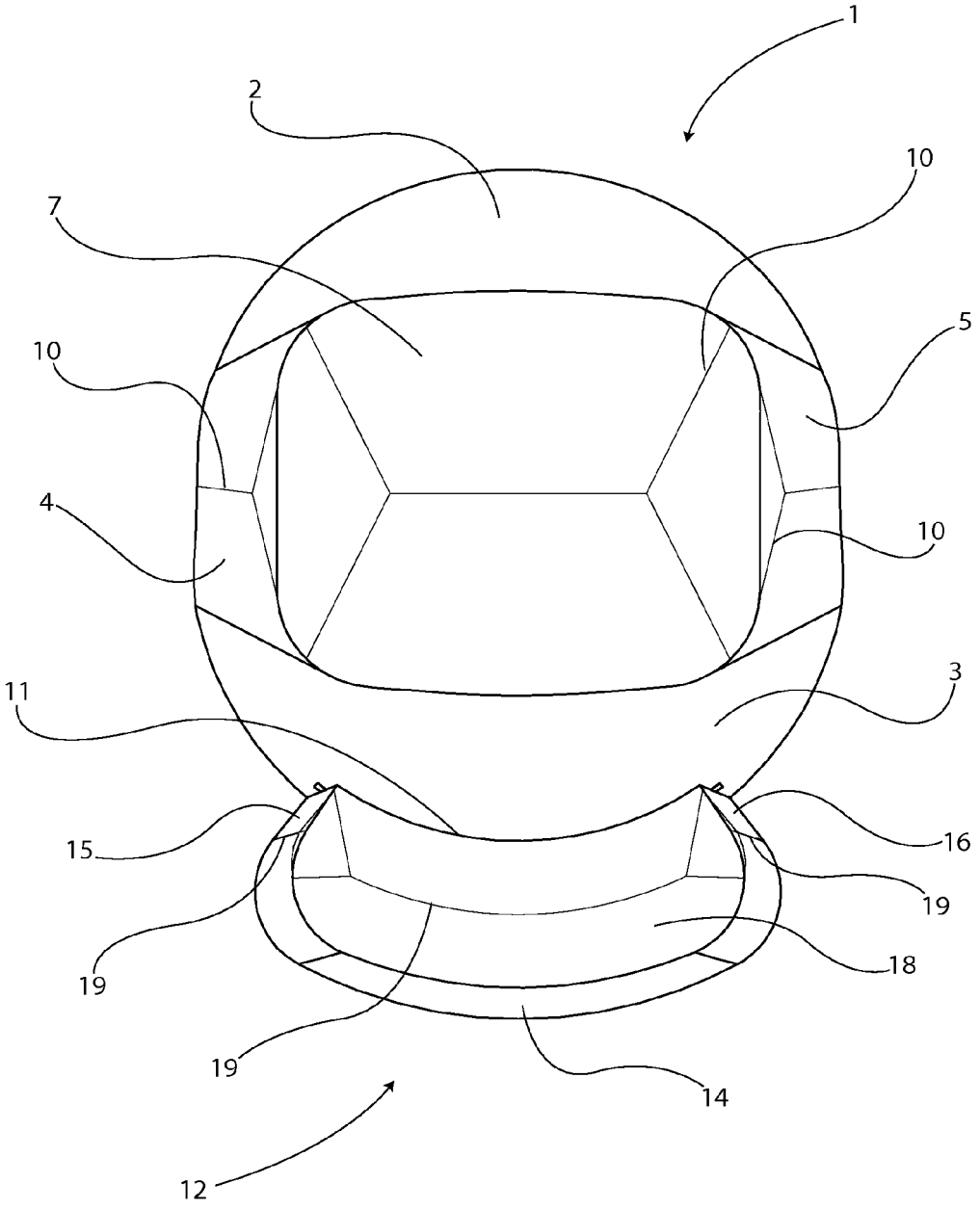
FIG. 3 is a bottom view of the present invention with condiment compartment expanded.
Figure 4:
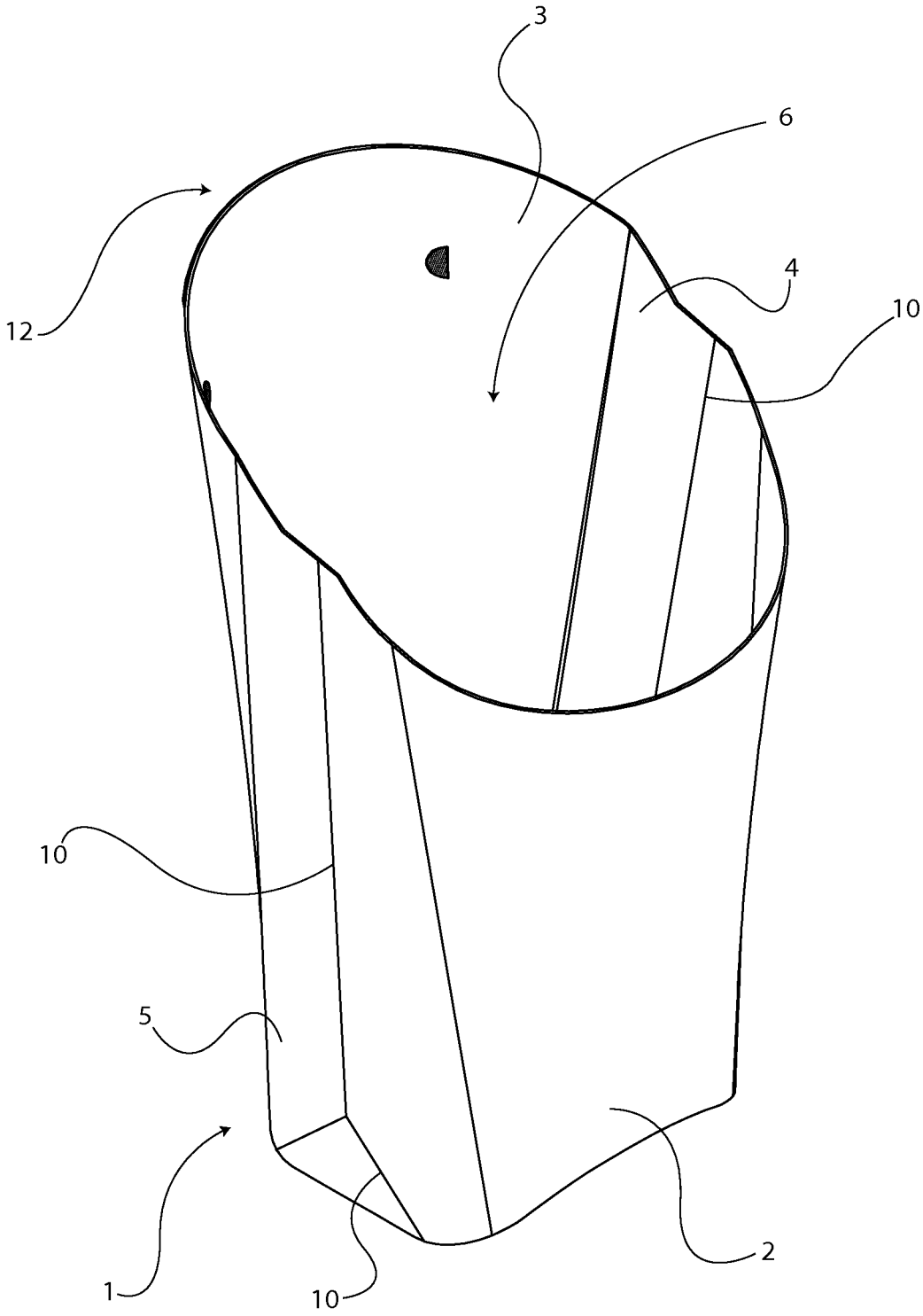
FIG. 4 is a perspective view of the present invention with the condiment compartment collapsed.
Figure 5:
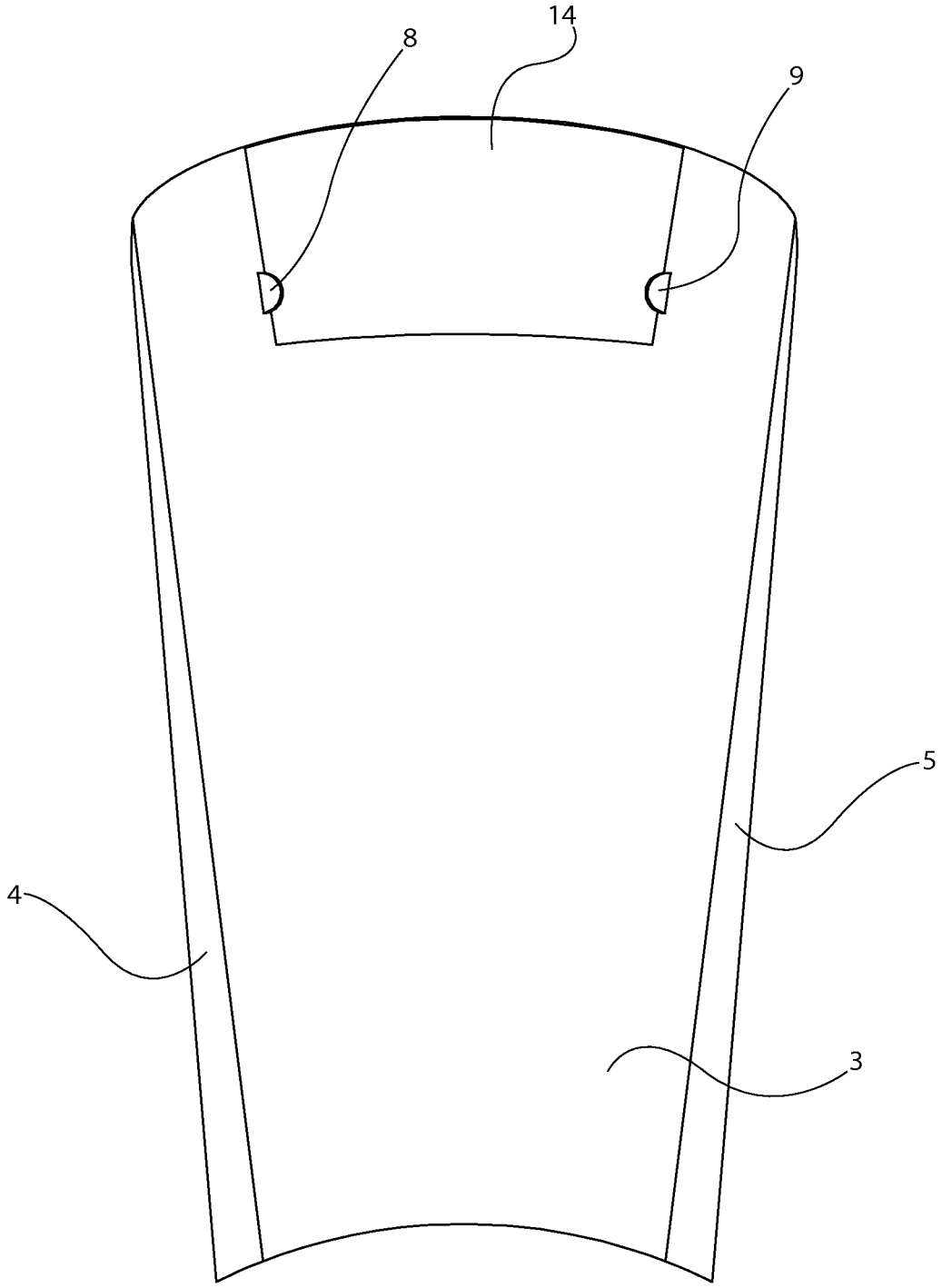
FIG. 5 is a back view of the present invention with the condiment compartment collapsed.
Figure 6:
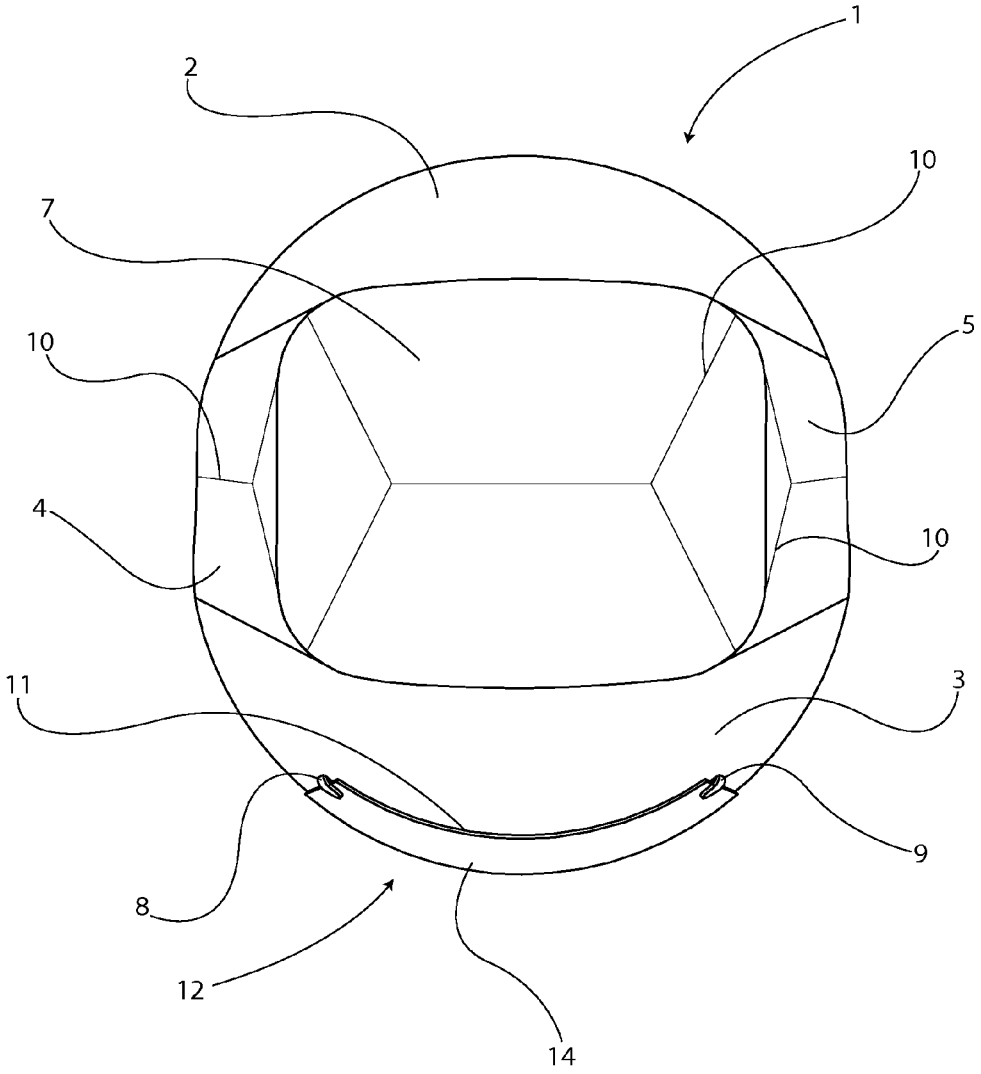
FIG. 6 is a bottom view of the present invention with the condiment compartment collapsed.

The present invention is a fries and condiment holder as shown in FIG. 1-3. The fries and condiment holder comprises three major components: a fry holder 1, an adhesive 11, and a condiment compartment 12. The fry holder 1 is an open container used to hold a food item sold at fast food restaurants such as McDonald's, Burger King, Wendy's, and Arby's. In the preferred embodiment, the food item is French fries, but any similar food items can be held by the fry holder 1. The condiment compartment 12 is a smaller open container used to hold condiments such as ketchup, mustard, barbeque sauce, sweet and sour sauce, and mayonnaise. The condiment compartment 12 is attached to the fry holder 1 by the adhesive 11. As can be seen from FIG. 4-6, the condiment compartment 12 is collapsible and can be completely flushed into the back of the fry holder 1 when the user does not want condiments with their French fries. The combination of three major components forms the fries and condiment holder.

The fry holder 1 is the larger open container having a front holder side 2, a back holder side 3, a left holder side 4, a right holder side 5, a fry opening 6, a bottom holder side 7, a left perforated flap 8, a right perforated flap 9, and a combination of holder folds 10. The front holder side 2 is the front side of the fry holder 1 and supports the French fries from the front. Similarly, the back holder side 3 is the back side of the fry holder 1 and supports the French fries from the back. The left holder side 4 is the left side of the fry holder 1 and supports the French fries from the left. The left holder side 4 connects the left edge of the front holder side 2 to the left edge of the back holder side 3. Likewise, the right holder side 5 is the right side of the fry holder 1 and supports the French fries from the right. The right holder side 5 connects the right edge of the front holder side 2 to the right edge of the back holder side 3. The bottom holder side 7 is the bottom side of the fry holder 1 and supports the French fries from the bottom. The bottom holder side 7 connects the bottom edge of the front holder side 2, the bottom edge of the back holder side 3, the bottom edge of the left holder side 4, and the bottom edge of the right holder side 5. The fry opening 6 is an aperture on the top of the fry holder 1, which allows the French fries to enter the fry holder 1. The fry opening 6 also allows the user easy access to the French fries. The left perforated flap 8 and the right perforated flap 9 are located equidistant from the center of the back holder side 3. The purpose of the left perforated flap 8 and the right perforated flap 9 is to keep the condiment compartment 12 collapsed when the user does not want any condiments. The combination of holder folds 10 is creases that are located on the left holder side 4, the right holder side 5, and the bottom holder side 7. The combination of holder folds 10 allow the fry holder 1 to collapse when the fry holder 1 is not being used.

The fry holder 1 supports the French fries so that the length of the French fries is normal to the bottom holder side 7, which allows the user equal access to every French fry in the fry holder 1. The dimensions of the components of the fry holder 1 should accommodate this feature of the present invention. For example, the height of the fry holder 1 should be relatively larger than the length and the width of the base so that the French fries cannot lay horizontally in the fry holder 1. Thus, the front holder side 2, the back holder side 3, the left holder side 4, and the right holder side 5 should have a height relatively larger than their width.

The condiment compartment 12 is the smaller open container comprising a front compartment panel 13, a back compartment panel 14, a left compartment panel 15, a right compartment panel 16, a condiment opening 17, a bottom compartment panel 18, and a combination of compartment folds 19. In the preferred embodiment, the condiment compartment 12 is made of paperboard or a material that is similarly flexible and foldable. The condiment compartment 12 does not have any holes on the bottom like traditional fry holder 1 because the condiment is usually a fluid and will flow out of the condiment compartment 12. The front compartment panel 13 is a rectangular piece of material, which prevents the condiment from flowing out of the front of the condiment compartment 12. The front compartment panel 13 is attached to the back holder side 7 by the adhesive 11. In the preferred embodiment, the adhesive 11 should be nontoxic because the present invention makes contact with food eaten by the user. The back compartment panel 14 is a rectangular piece of material, which prevents the condiment from flowing out of the back of the condiment compartment 12. The left compartment panel 15 is a rectangular piece of material, which prevents the condiment from flowing out of the left side of the condiment compartment 12. The left compartment panel 15 connects the left edge of the front compartment panel 13 to the left edge of the back compartment panel 14. The right compartment panel 16 is a rectangular piece of material, which prevents the condiment from flowing out of the right side of the condiment compartment 12. The right compartment panel 16 connects the right edge of the front compartment panel 13 to the right edge of the back compartment panel 14. The bottom compartment panel 18 is a rectangular piece of material, which prevents the condiment from flowing out of the bottom of the condiment compartment 12. The bottom compartment panel 18 connects the bottom edge of the front compartment panel 13, the bottom edge of the back compartment panel 14, the bottom edge of the left compartment panel 15, and the bottom edge of the right compartment panel 16. The condiment opening 17 is an aperture located at the top of the condiment compartment 12 and allow the user to fill the condiment compartment 12 with the condiment. The combination of compartment folds 19 is creases that are located on the left compartment panel 15, the right compartment panel 16, and the bottom compartment panel 18. The combination of compartment folds 19 allows the condiment compartment 12 to collapse and to be flushed into back holder side 3 in an aesthetically pleasing manner. The present invention starts with the condiment compartment 12 flushed into the back holder side 3 and with the left perforated flap 8 and the right perforated flap 9 against the back compartment panel 14 to keep the condiment compartment 12 flushed. Once the user obtains the present invention with French fries in the fry holder 1, the user can employ his/her discretion on whether or not to expand and use the condiment compartment 12.

The condiment compartment 12 is designed to be more shallow, which exposes more of the condiment filling the condiment compartment 12 to the user. The condiment will have a larger surface area for the user to dip the French fries, which will keep the user's hands from touching the condiment or the condiment compartment 12. The dimensions of the components of the condiment holder should reflect this feature of the present invention. For example, the width of the condiment compartment 12 should be relatively larger than the length and the height. Thus, the front compartment panel 13 and the back compartment panel 14 have a width relatively larger than their height. The left compartment panel 15 and the right compartment panel 16 have a width comparable to their height.

Although the invention has been explained in relation to its preferred embodiment, it is to be understood that many other possible modifications and variations can be made without departing from the spirit and scope of the invention as hereinafter claimed.

What is claimed is:

1. A fries and condiment holder comprises, a fry holder;

an adhesive;

a condiment compartment;

said fry holder being attached to said condiment compartment by said adhesive;

said fry holder comprises a front holder side, a back holder side, a left holder side, a right holder side, a fry opening, a bottom holder side, a left perforated flap, a right perforated flap, and a combination of holder folds;

said condiment compartment comprises a front compartment panel, a back compartment panel, a left compartment panel, a right compartment panel, a condiment opening, a bottom compartment panel, and a combination of compartment folds;

said left perforated flap being located on said back holder side;

said right perforated flap being located on said back holder side;

said combination of holder folds being positioned on said left holder side, said right holder side, and said bottom holder side;

said combination of compartment folds being positioned on said left compartment panel, said right compartment panel, and said bottom compartment panel;

said left perforated flap being positioned adjacent to said left compartment panel;

said right perforated flap being positioned adjacent to said right compartment panel;

said left perforated flap and right perforated are configured to hold the condiment compartment in a collapsed position said left holder side being connected adjacent to said front holder side;

said right holder side being connected adjacent to said front holder side opposite of said left holder side;

said back holder side being connected adjacent to said left holder side opposite of said front holder side;

said back holder side being connected adjacent to said right holder side opposite of front holder side;

said bottom holder side being connected below said front holder side, said back holder side, said left holder side, and said right holder side;

said fry opening being located atop said front holder side, said back holder side, said left holder side, and said right holder side;

said left compartment panel being connected adjacent to said front compartment panel;

said right compartment panel being connected adjacent to said front compartment panel opposite of said left compartment panel;

said back compartment panel being connected adjacent to said left compartment panel opposite of said front compartment panel;

said back compartment panel being connected adjacent to said right compartment panel opposite of said front compartment panel;

said bottom compartment panel being connected below said front compartment panel, said back compartment panel, said left compartment panel, and said right compartment panel; and said condiment opening is being located atop said front compartment panel, said back compartment panel, said left compartment panel, and said right compartment panel.

2. A fries and condiment holder comprises, a fry holder;

an adhesive;

a condiment compartment;

said fry holder being attached to said condiment compartment by said adhesive;

said fry holder comprises a front holder side, a back holder side, a left holder side, a right holder side, a fry opening, a bottom holder side, a left perforated flap, a right perforated flap, and a combination of holder folds; and said condiment compartment comprises a front compartment panel, a back compartment panel, a left compartment panel, a right compartment panel, a condiment opening, a bottom compartment panel, and a combination of compartment folds;

said left holder side being connected adjacent to said front holder side;

said right holder side being connected adjacent to said front holder side opposite of said left holder side;

said back holder side being connected adjacent to said left holder side opposite of said front holder side;

said back holder side being connected adjacent to said right holder side opposite of front holder side;

said bottom holder side being connected below said front holder side, said back holder side, said left holder side, and said right holder side;

said fry opening being located atop said front holder side, said back holder side, said left holder side, and said right holder side;

said left perforated flap being located on said back holder side;

said right perforated flap being located on said back holder side;

said combination of holder folds being positioned on said left holder side, said right holder side, and said bottom holder side;

said left compartment panel being connected adjacent to said front compartment panel;

said right compartment panel being connected adjacent to said front compartment panel opposite of said left compartment panel;

said back compartment panel being connected adjacent to said left compartment panel opposite of said front compartment panel;

said back compartment panel being connected adjacent to said right compartment panel opposite of said front compartment panel;

said bottom compartment panel being connected below said front compartment panel, said back compartment panel, said left compartment panel, and said right compartment panel;

said condiment opening is being located atop said front compartment panel, said back compartment panel, said left compartment panel, and said right compartment panel;

said combination of compartment folds being positioned on said left compartment panel, said right compartment panel, and said bottom compartment panel; and said back holder side being attached to said front compartment panel by said adhesive said left perforated flap being positioned adjacent to said left compartment panel;

said right perforated flap being positioned adjacent to said right compartment panel; and said left perforated flap and right perforated are configured to hold the condiment compartment in a collapsed position.

* * * * *